US009145790B2

(12) United States Patent
Miyazaki

(10) Patent No.: US 9,145,790 B2
(45) Date of Patent: Sep. 29, 2015

(54) PUMP, PUMP SYSTEM, METHOD OF CONTROLLING PUMP, AND COOLING SYSTEM

(71) Applicant: FUJITSU LIMITED, Kawasaki-shi, Kanagawa (JP)

(72) Inventor: Takehide Miyazaki, Yokohama (JP)

(73) Assignee: FUJITSU LIMITED, Kawasaki (JP)

( * ) Notice: Subject to any disclaimer, the term of this patent is extended or adjusted under 35 U.S.C. 154(b) by 324 days.

(21) Appl. No.: 13/685,941

(22) Filed: Nov. 27, 2012

(65) Prior Publication Data

US 2013/0243566 A1 Sep. 19, 2013

(30) Foreign Application Priority Data

Mar. 19, 2012 (JP) ..... 2012-062908

(51) Int. Cl.

| | |
|---|---|
| ***F01D 19/00*** | (2006.01) |
| ***F04D 13/06*** | (2006.01) |
| ***F04D 15/00*** | (2006.01) |
| ***F04D 29/042*** | (2006.01) |

(52) U.S. Cl.

CPC ..... *F01D 19/00* (2013.01); *F04D 13/064* (2013.01); *F04D 15/0027* (2013.01); *F04D 29/042* (2013.01)

(58) Field of Classification Search

CPC ..... F04D 13/064; F04D 15/0027; F04D 15/0033; F04D 29/042; F01D 19/00

USPC ..... 415/129, 133; 417/216, 426; 310/68 R, 310/68 B, 68 D, 68 E; 318/432, 434, 599, 318/811, 400.34, 400.37, 400.39, 400.4; 388/800, 811, 819

See application file for complete search history.

(56) References Cited

U.S. PATENT DOCUMENTS

| | | | | |
|---|---|---|---|---|
| 8,636,638 | B2 * | 1/2014 | Timms | 600/16 |
| 2005/0180105 | A1 | 8/2005 | Matsushima et al. | |

FOREIGN PATENT DOCUMENTS

| | | | |
|---|---|---|---|
| DE | 2510787 | * | 9/1976 |
| JP | 2005-228237 | | 8/2005 |
| WO | WO2010118476 | * | 10/2010 |

* cited by examiner

*Primary Examiner* — Devon Kramer
*Assistant Examiner* — Patrick Hamo
(74) *Attorney, Agent, or Firm* — Staas & Halsey LLP

(57) ABSTRACT

A pump includes: an impeller that moves fluid; a housing section, provided adjacent to a channel for the fluid, that communicate with the channel; and a controller that positions the impeller in the channel during a driving of the impeller and houses the impeller in the housing section during a stoppage of driving of the impeller.

6 Claims, 17 Drawing Sheets

PUMP, PUMP SYSTEM, METHOD OF CONTROLLING PUMP, AND COOLING SYSTEM

CROSS-REFERENCE TO RELATED APPLICATION(S)

This application is based upon and claims the benefit of priority of the prior Japanese Patent Application No. 2012-62908, filed on Mar. 19, 2012, the entire contents of which are incorporated herein by reference.

FIELD

The embodiments discussed herein are related to a pump, pump system, method of controlling a pump, and cooling system.

BACKGROUND

Communication equipment or information processing equipment includes a cooling system that provides cooling by fluid circulation.

A related technique is disclosed in Japanese Laid-open Patent Publication No. 2005-228237.

SUMMARY

According to one aspect of the embodiments, a pump includes: an impeller that moves fluid; a housing section, provided adjacent to a channel for the fluid, that communicate with the channel; and a controller that positions the impeller in the channel during a driving of the impeller and houses the impeller in the housing section during a stoppage of driving of the impeller.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

A pump that moves fluid includes a turbopump that drives an impeller. The impeller is positioned in a channel in the turbopump. Thus, if the pump comes to a stop, the impeller halting its rotation may be an obstacle to the channel and a pressure loss in the channel may be increased.

For example, when a plurality of pumps are disposed in series, if one of the plurality of pumps comes to a stop, the impeller of the stopped pump may be an obstacle and hinder the running of the other pumps. For example, if a natural flow of fluid may be expected from the structure of the channel in design, the impeller of the stopped pump may be an obstacle to the natural flow. For example, a bypass that bypasses the stopped pump may be provided. Components, including a pipe and a valve for forming the bypass, may be increased, and the channel may be complicated.

Figure 1:
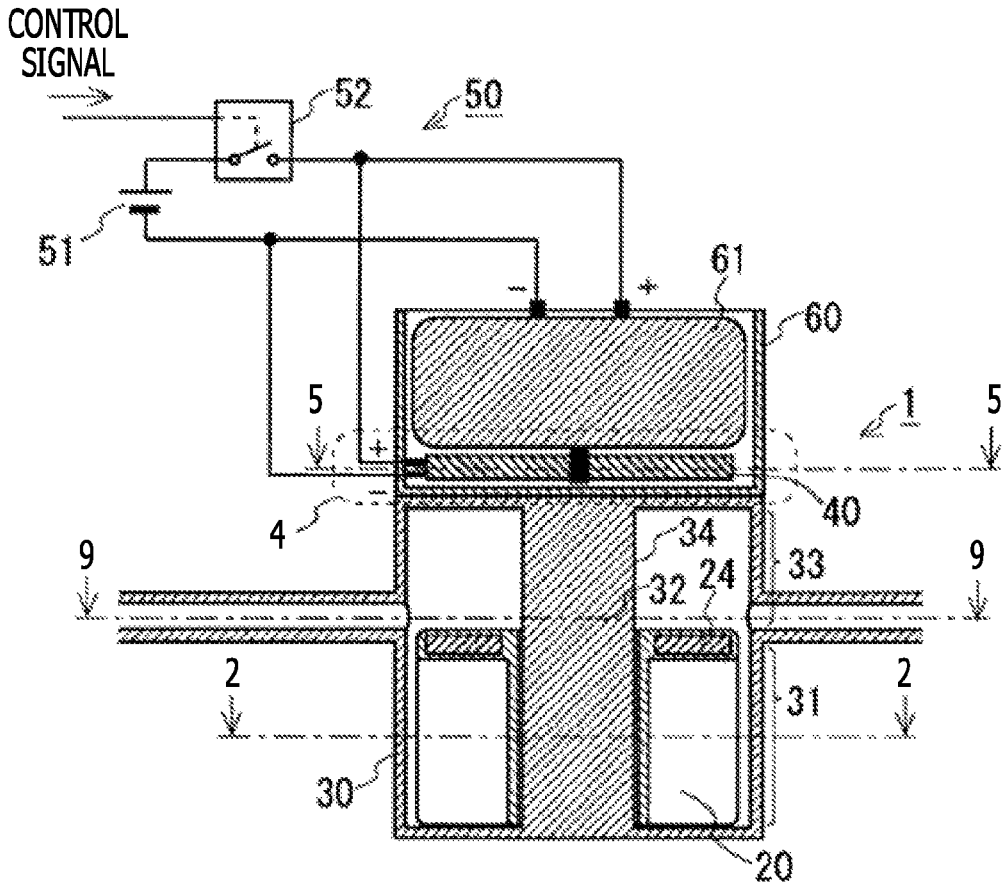
FIG. 1 illustrates an exemplary pump.

FIG. 1 illustrates an exemplary pump. A pump 1 illustrated in FIG. 1 may be a turbopump that moves fluid by rotation of an impeller. For example, the pump 1 includes an impeller 20 that moves fluid.

The impeller 20 is positioned inside a pump casing 30 and moves fluid with which the inside of the pump casing 30 is filled. The fluid moved by the impeller 20 may be either liquid or gas. The impeller 20 is driven by rotational power of a motor 61 in a motor casing 60 attached to the pump casing 30, thus moving the fluid.

The rotational power of the motor 61 is transmitted to the impeller 20 through magnetism produced by an electromagnet section 40 rotated by the motor 61. For example, the impeller 20 includes a permanent magnet 24 that rotates following to magnetism of the electromagnet section 40. The permanent magnet 24 follows to movement of the electromagnet section 40 and rotates, thereby driving the impeller 20.

A pump chamber channel 33 in which the impeller 20 is positioned when the pump 1 runs is disposed inside the pump casing 30 including the impeller 20. The pump chamber channel 33 may form a portion of the channel for the fluid. The pump chamber channel 33 is coupled to a pipe that allows fluid to flow in the inside of the pump casing 30 to pass therethrough and to a pipe that allows fluid to flow out of the inside of the pump casing 30 to pass therethrough.

A housing section 31 adjacent to and in communication with the pump chamber channel 33 is disposed inside the pump casing 30 at a location that is opposite to the electromagnet section 40 such that the pump chamber channel 33 is positioned therebetween, for example, at the location below the pump chamber channel 33 illustrated in FIG. 1. The housing section 31 may have a size to house the impeller 20.

A rotating shaft 32 by which the impeller 20 is rotatably supported is disposed inside the pump casing 30. The rotating shaft 32 is positioned in a central portion inside the pump casing 30 and extends between the inside of the housing section 31, which is positioned in a lower portion inside the pump casing 30, and the inside of the pump chamber channel 33, which is positioned in an upper portion inside the pump casing 30. The lower end of the rotating shaft 32 is fixed to the bottom of the housing section 31. The upper end of the rotating shaft 32 is fixed to the top of the pump chamber channel 33. The rotating shaft 32 includes an outer circumferential surface 34 on which the impeller 20 is axially slideable. The impeller 20 is rotatably supported by the outer circumferential surface 34. Thus, the impeller 20 slides along the rotating shaft 32 and may move to both the housing section 31 and the pump chamber channel 33 inside the pump casing 30.

The pump casing 30 is sealed except for the connections with the pipes attached to the outer sides of the pump casing 30. Thus, leakage of fluid inside the pump casing 30 from portions other than the connections with the pipes is reduced.

The pump 1 includes a motor circuit 50. The motor circuit 50 may be an electric circuit that controls an electric power supplied to the motor 61 and the electromagnet section 40 and includes a power source 51 and a switch 52. The switch 52 controls an electric power to be supplied from the power source 51 to the motor 61 and the electromagnet section 40 in accordance with a control signal input from the outside. For example, when receiving a control signal that turns on the pump 1, the switch 52 operates so as to supply an electric power from the power source 51 to the motor 61 and the electromagnet section 40 to both start the motor 61 and bring the electromagnet section 40 to an energized state. When receiving a control signal that turns off the pump 1, the switch 52 operates so as to interrupt the electric power supplied from the power source 51 to the motor 61 and the electromagnet section 40 to both stop the motor 61 and bring the electromagnet section 40 to a non-energized state.

Figure 2:
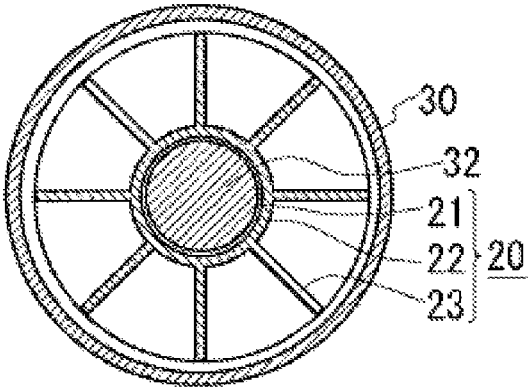
FIG. 2 illustrates an exemplary cross section of a pump.

FIG. 2 illustrates an exemplary cross section of the pump. FIG. 2 may be a cross-sectional view of the pump 1 taken along the line 2-2 illustrated in FIG. 1. The impeller 20 includes a cylindrical bearing 22 having a through hole 21 through which the rotating shaft 32 passes formed in its rotation center portion and a plurality of vanes 23 extending radially from the outer circumferential side of the bearing 22. Thus, when the impeller 20 rotates about the bearing 22, the vanes 23 extrude fluid filling the inside of the pump casing 30 from upstream to downstream, thereby causing the fluid to flow.

Figure 3:
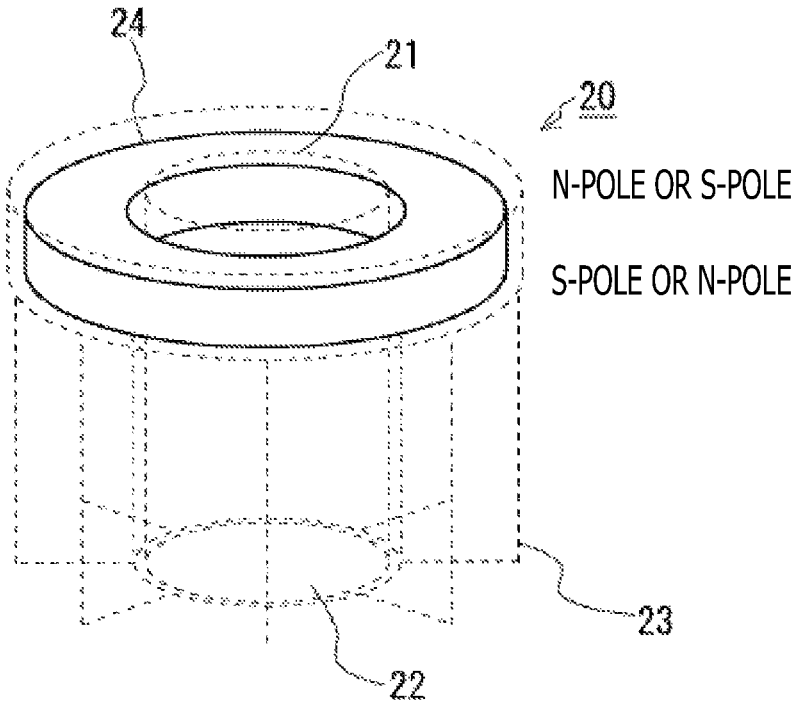
FIG. 3 illustrates an exemplary impeller.

FIG. 3 illustrates an exemplary impeller. In FIG. 3, the impeller 20 is provided with the permanent magnet 24. The impeller 20 includes the permanent magnet 24 being annular and surrounding the periphery of the through hole 21 at the end adjacent to the electromagnet section 40 illustrated in FIG. 1, for example. The permanent magnet 24 includes an end that is adjacent to the electromagnet section 40 and that forms a magnetic pole of either the north pole or the south pole and another end that is remote from the electromagnet section 40 and that forms a magnetic pole of the pole opposite to that of the end adjacent to the electromagnet section 40. For example, the impeller 20 may include a magnetic element made of a material having small residual magnetism, such as iron, instead of the permanent magnet 24.

Figure 4:
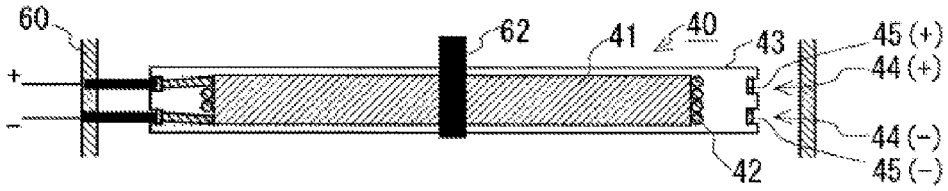
FIG. 4 illustrates an exemplary part of a pump.
Figure 5:
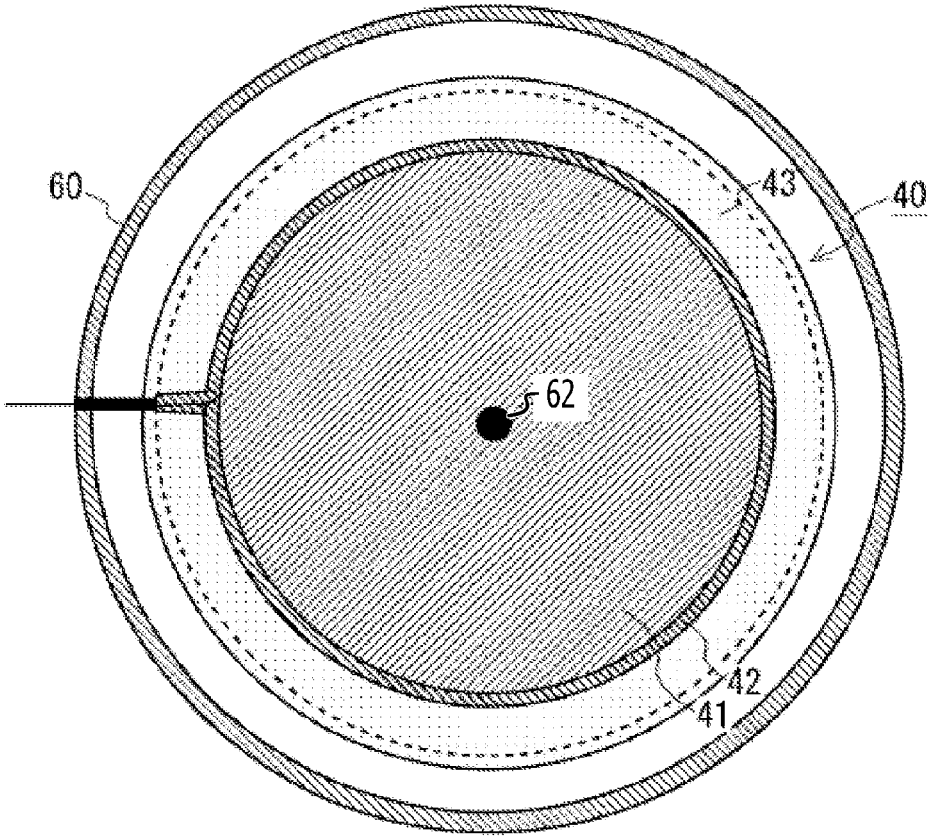
FIG. 5 illustrates an exemplary part of a pump.

FIG. 4 illustrates an exemplary part of a pump. For example, FIG. 4 illustrates an enlarged view of a part of the pump 1 indicated by the character 4 in FIG. 1. FIG. 5 illustrates an exemplary part of a pump. For example, FIG. 5 illustrates a cross-sectional view of the part of the pump 1 taken along the line 5-5 illustrated in FIG. 1. The electromagnet section 40 is fixed to a drive shaft 62 for the motor 61 and rotates together with the drive shaft 62 for the motor 61. The electromagnet section 40 includes a magnetic element 41, a coil 42, a cover 43, electrode receiving grooves 44(+) and 44(−), and conductive rings 45(+) and 45(−). The magnetic element 41 may be a disc-shaped magnetic element and is attached to the drive shaft 62 for the motor 61. The coil 42 is wound around the magnetic element 41 so as to circle around the outer circumferential side of the magnetic element 41. The cover 43 may be a disc-shaped cover in which the magnetic element 41 and the coil 42 are housed. The electrode receiving grooves 44(+) and 44(−) are grooves that circle in parallel with each other in the outer circumferential side. The conductive rings 45(+) and 45(−) are conductive rings fit in the electrode receiving grooves 44(+) and 44(−), respectively.

Figure 6:
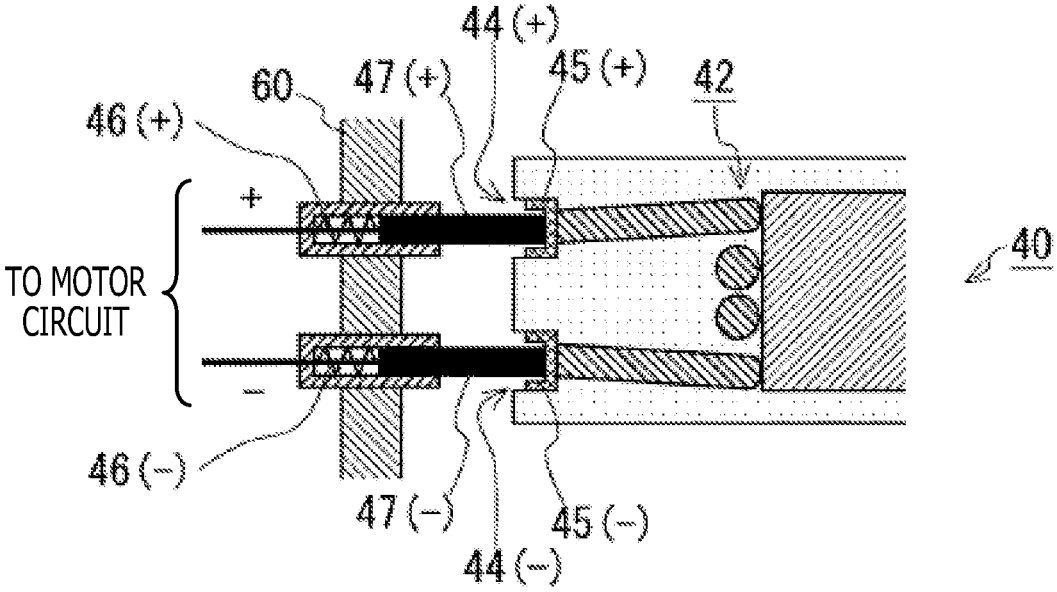
FIG. 6 illustrates an exemplary part of a pump.

FIG. 6 illustrates an exemplary part of a pump. For example, FIG. 6 illustrates the electrical connection between the electromagnet section 40 and the motor circuit 50. One end of the coil 42 is electrically coupled to the conductive ring 45(+), and another end of the coil 42 is electrically coupled to the conductive ring 45(−). The conductive ring 45(+) is in contact with an electromagnetic electrode (also called brush) 47(+) attached to the motor casing 60. The conductive ring 45(−) is also in contact with an electromagnetic electrode 47(−) attached to the motor casing 60, similarly to the conductive ring 45(+). The electromagnetic electrode 47(+) is pressed against the conductive ring 45(+) by a spring 46(+). The electromagnetic electrode 47(−) is also pressed against the conductive ring 45(−) by a spring 46(−). The electromagnetic electrodes 47(+) and 47(−) are coupled to the motor circuit 50. Thus, when electricity is supplied from the motor circuit 50, the electricity flows in the coil 42 through the electromagnetic electrodes 47(+) and 47(−) and the conductive rings 45(+) and 45(−).

Figure 7:
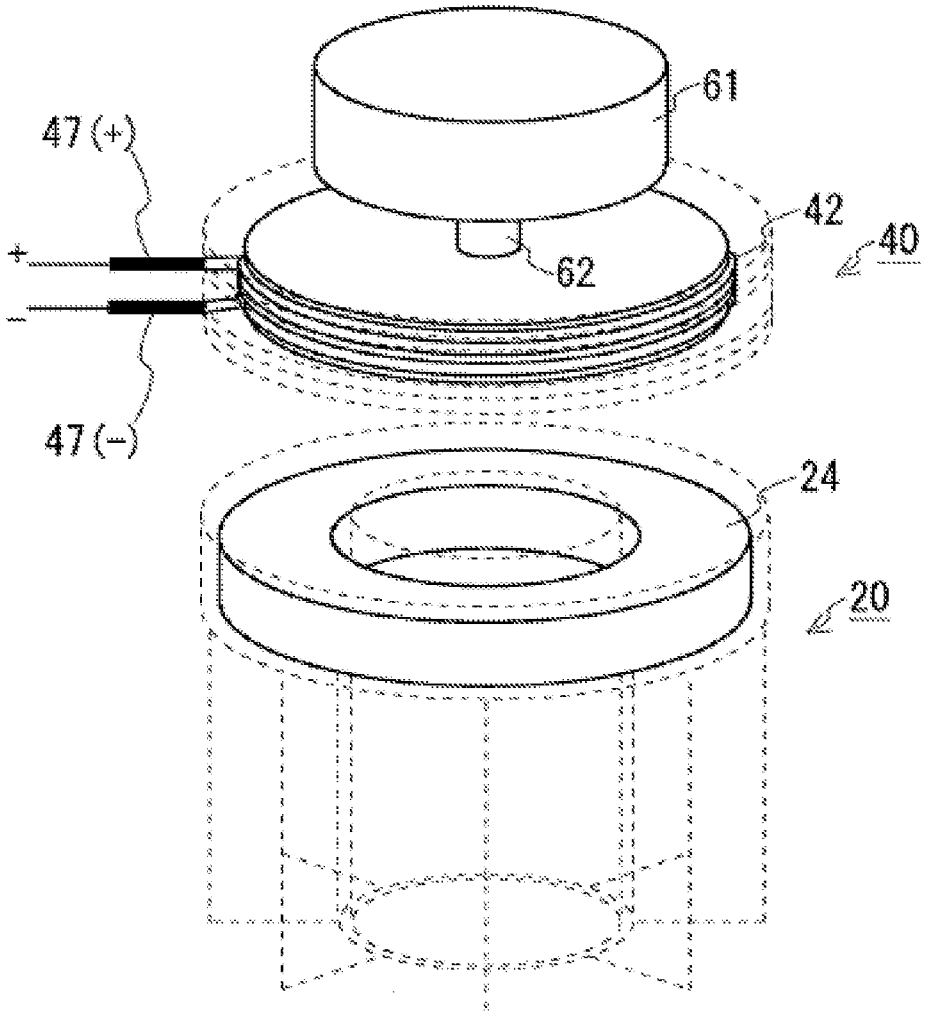
FIG. 7 illustrates an exemplary positional relationship in a part of the pump.

FIG. 7 illustrates an exemplary positional relationship in a part of a pump. For example, FIG. 7 illustrates the positional relationship among the electromagnet section 40, motor 61, and impeller 20. When the motor 61 rotates, the electromagnet section 40 fixed to the drive shaft 62 for the motor 61 rotates. When the electromagnet section 40 rotates, the conductive ring 45(+) rotates in a state where the conductive ring 45(+) is in electrical contact with the electromagnetic electrode 47(+) and the conductive ring 45(−) rotates in a state where the conductive ring 45(−) is in electrical contact with the electromagnetic electrode 47(−). Thus, even when the motor 61 is in a rotating state, electricity may be fed from the motor circuit 50 to the coil 42, and the coil 42 may be energized.

When the motor 61 rotates in a state where the coil 42 is energized, an eddy current occurs in the permanent magnet 24 receiving the magnetism of the coil 42. Thus, the impeller 20 is driven by interaction between the eddy current occurring in the permanent magnet 24 and a magnetic field produced by the coil 42.

The orientation of the coil 42, the direction of the electrical current passing through the coil 42, or the orientation of the permanent magnet 24 in the electromagnet section 40 is adjusted such that the magnetic pole of the end of the electromagnet section 40 adjacent to the impeller 20 has the polarity opposite to the magnetic pole of the end of the permanent magnet 24 adjacent to the electromagnet section 40. When the electromagnet section 40 is brought to an energized state by the passage of an electric current in the electromagnet section 40, the impeller 20, which includes the permanent magnet 24, moves along the rotating shaft 32 and is attracted to the electromagnet section 40. If the impeller 20 includes a magnetic element made of a material having small residual magnetism, such as iron, the polarity of the magnetic pole of the end of the electromagnet section 40 adjacent to the impeller 20 may be either the north pole or the south pole.

Figure 8:
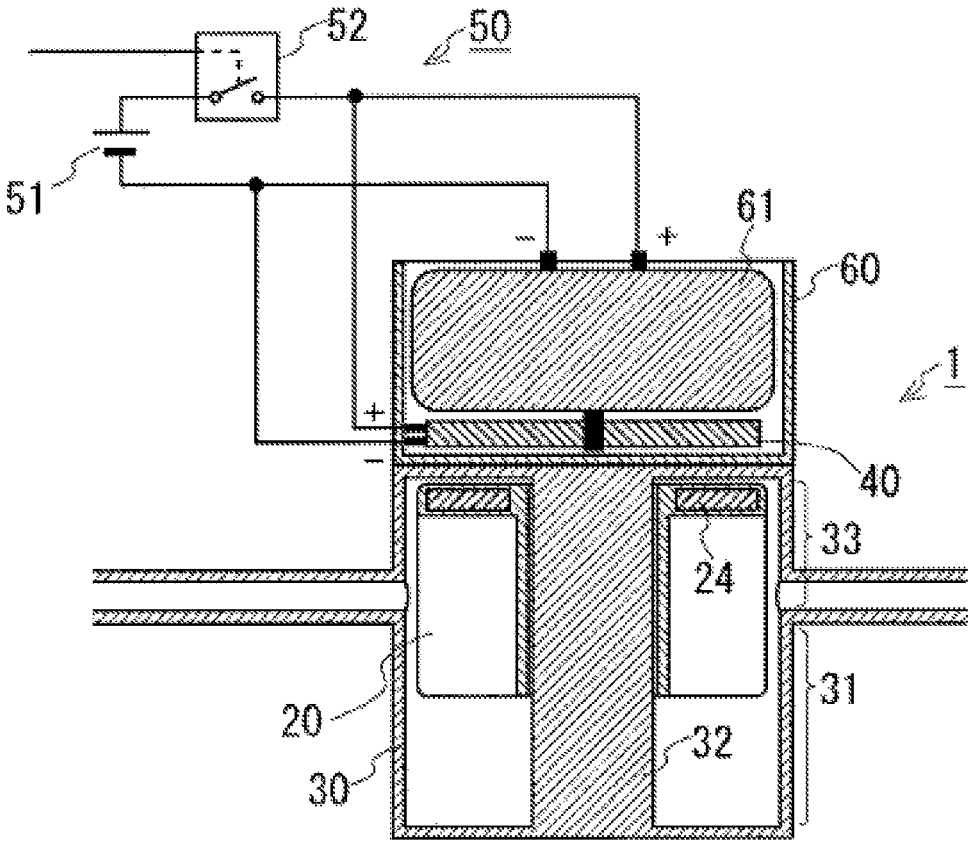
FIG. 8 illustrates an exemplary internal structure of a pump.

FIG. 8 illustrates an exemplary internal structure of a pump. For example, FIG. 8 may illustrate the internal structure of the pump 1 when the impeller 20 is attracted to the electromagnet section 40. When the electromagnet section 40 is brought to an energized state, the impeller 20 is attracted to the electromagnet section 40, as illustrated in FIG. 8. When the electromagnet section 40 is brought to a non-energized state, the magnetism of attracting the impeller 20 to the electromagnet section 40 is reduced, and the impeller 20 is moved to the housing section 31 by its own weight, as illustrated in FIG. 1. For example, the impeller 20 is positioned inside the pump chamber channel 33 or housed in the housing section 31 in the pump 1 under the control on an electrical current passing through the coil 42 of the electromagnet section 40.

Because the impeller 20 is positioned inside the pump chamber channel 33 or housed in the housing section 31, situations where the stopped impeller 20 becomes an obstacle to the channel may be reduced.

Figure 9:
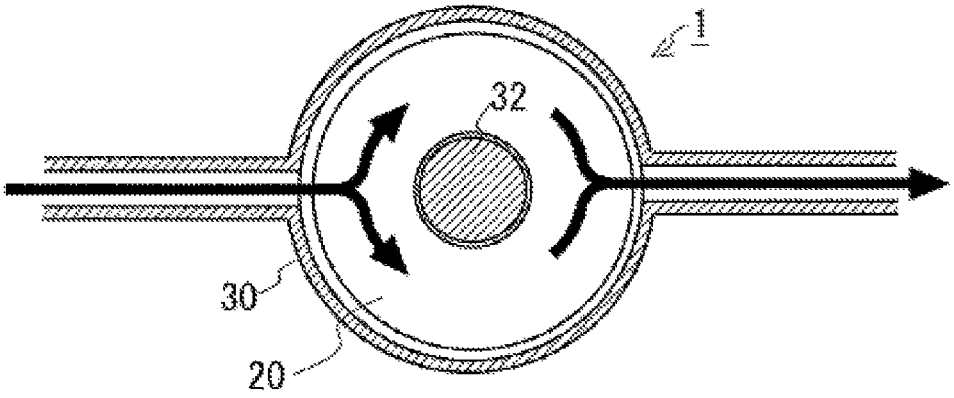
FIG. 9 illustrates an exemplary part of the pump.

The switch 52 illustrated in FIG. 1 becomes an "open" state based on a control signal indicating "stop," and the feeding of electricity to the motor 61 and electromagnet section 40 is interrupted. The impeller 20 comes to a stop, is housed in the housing section 31, as illustrated in FIG. 1, and may fail to become an obstacle to the channel. FIG. 9 illustrates an exemplary part of a pump. FIG. 9 illustrates a cross-sectional view of the part of the pump 1 taken along the line 9-9 illustrated in FIG. 1. In a state where the pump 1 does not run, when the impeller 20 is housed in the housing section 31, the impeller 20 is absent from the pump chamber channel 33. Thus, the impeller 20 may fail to become the obstacle to fluid moving into the pump casing 30 of the pump 1, passing through the pump chamber channel 33, and moving out of the pump casing 30, whereby the channel may be ensured.

The number of magnetic poles of the end of the electromagnet section 40 adjacent to the permanent magnet 24 and the number of magnetic poles of the end of the permanent magnet 24 adjacent to the electromagnet section 40 may be one or more than one. Power may be transmitted by the use of attraction and repulsion of the magnet.

The impeller 20 may be moved to the housing section 31 by its own weight. For example, the impeller 20 may be moved to the housing section 31 by the use of repulsion of an elastic body, such as a spring or sponge, when the electromagnet section 40 is in a non-energized state. When repulsion of an elastic body is used, the housing section 31 may be positioned below, at the side of, or above the pump chamber channel 33. The electromagnet section 40 may obtain power directly from the drive shaft 62 for the motor casing 60 or, for example, may indirectly obtain power through a power transmitting unit, such as a transmission mechanism.

The degree of flexibility in the pump mounting direction in the above-described configuration may be increased. For example, the pump illustrated in FIG. 1 may be mounted such that the top in the drawing is oriented downward.

The electromagnet section 40 may be electrically coupled to the motor circuit 50 through the conductive rings 45(+) and 45(−) disposed on the outer circumferential side of the cover 43. The electromagnet section 40 may be electrically coupled to the motor circuit 50 through a conductive ring disposed in the vicinity of the drive shaft 62, for example. Power may be fed to the electromagnet section 40 through electric wire coupled to a rotor coil of the motor 61.

The electrical connection between the electromagnet section 40 and the motor circuit 50 may have a configuration in which a coil spring and a brush are combined. The electrical connection between the electromagnet section 40 and the motor circuit 50 may include a leaf spring or may have a configuration in which a brush itself is a leaf spring, for example.

The motor casing 60 and the pump casing 30 in the pump 1 may be separate components to facilitate replacement of the motor 61. The pump casing 30 and the motor casing 60 may be integrated.

The pump casing 30 may be formed from a cylindrical component. The pump casing 30 may have a cubic shape, a conical shape, or other shapes where the housing section 31 and the pump chamber channel 33 may be formed therein.

The opposite ends of the rotating shaft 32 may be fixed to the bottom of the housing section 31 and the top of the pump chamber channel 33, respectively. One end of the rotating shaft 32 may be fixed to the bottom of the housing section 31 or the top of the pump chamber channel 33, for example.

The impeller 20 may be rotatably supported by the rotating shaft 32. The impeller 20 may be supported by being in contact with the inner circumferential wall of the pump casing 30 having a cylindrical shape, instead of by the rotating shaft 32, for example. The impeller 20 may be supported inside the pump casing 30 by magnetic force, for example.

Figure 10:
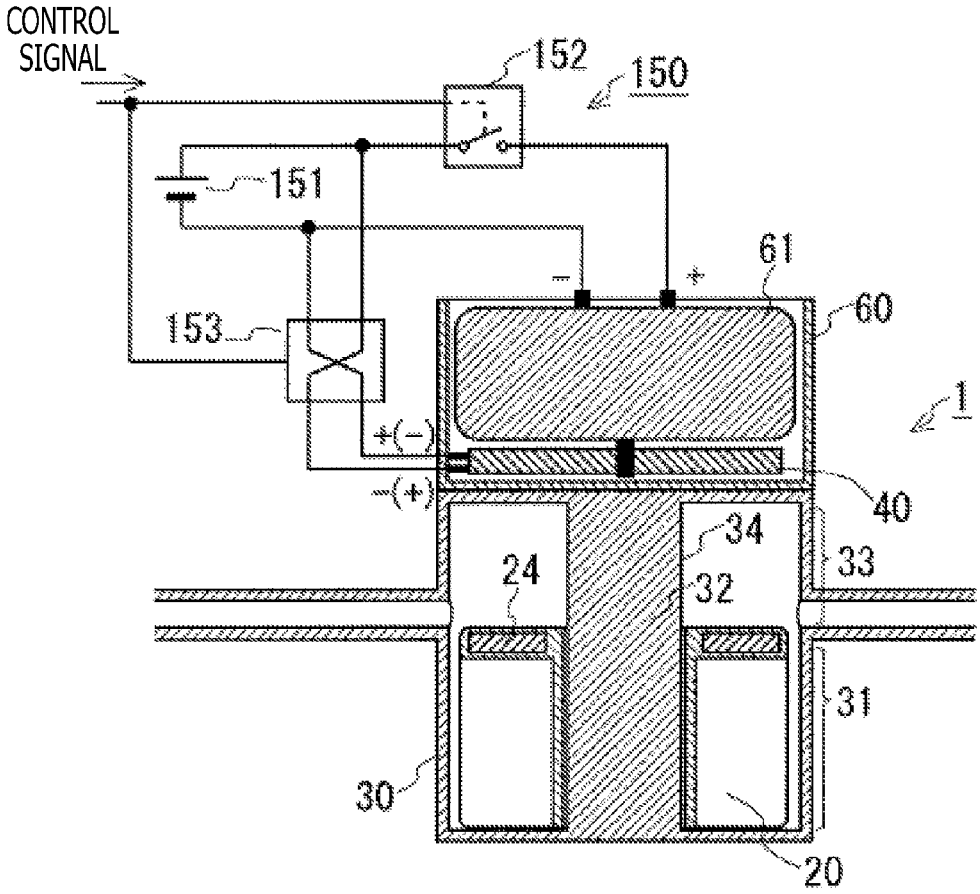
FIG. 10 illustrates an exemplary motor circuit.

The impeller 20 may be moved to the housing section 31 by inversion of the polarity of each of the magnetic poles of the electromagnet section 40. FIG. 10 illustrates an exemplary motor circuit. A motor circuit 150 illustrated in FIG. 10 inverts the polarity of the magnetic pole of the electromagnet section 40.

The motor circuit 150 includes a power source 151, a switch 152, and a polarity inverter 153, similarly to the motor circuit 50 illustrated in FIG. 1.

The switch 152 controls electric power supplied from the power source 151 to the motor 61 based on a control signal input from the outside. For example, when a control signal that turns on the pump 1 is input to the switch 152, electric power is supplied from the power source 151 to the motor 61, and the motor 61 starts. When a control signal that turns off the pump 1 is input to the switch 152, electric power supplied from the power source 151 to the motor 61 is interrupted, and the motor 61 comes to a stop.

The polarity inverter 153 inverts the polarity of electricity to be sent from the power source 151 to the electromagnet section 40. For example, when a control signal that turns on the pump 1 is input to the polarity inverter 153, the polarity inverter 153 energizes the electromagnet section 40 such that the polarity of the magnetic pole of the end of the electromagnet section 40 adjacent to the permanent magnet 24 is opposite to the polarity of the magnetic pole of the end of the permanent magnet 24 adjacent to the electromagnet section 40. When a control signal that turns off the pump 1 is input to the polarity inverter 153, the polarity inverter 153 energizes the electromagnet section 40 such that the polarity of the magnetic pole of the end of the electromagnet section 40 adjacent to the permanent magnet 24 becomes the same as the polarity of the magnetic pole of the end of the permanent magnet 24 adjacent to the electromagnet section 40.

For example, when the pump 1 illustrated in FIG. 1 is coupled to the motor circuit 150 illustrated in FIG. 10, in the case where a control signal that turns on the pump is input, the impeller 20 is attracted to the electromagnet section 40 by attraction of magnetism. In the case where a control signal that turns off the pump is input, the impeller 20 is forced away from the electromagnet section 40 by repulsion of magnetism.

Thus, the impeller 20 in the case where the motor circuit 150 illustrated in FIG. 10 is used in the pump 1 illustrated in FIG. 1 may be housed in the housing section 31 more quickly than that in the case where the motor circuit 50 illustrated in FIG. 1 is used.

The degree of flexibility in the pump mounting direction in the above-described configuration may be increased. For example, the pump illustrated in FIG. 1 may be mounted such that the top in the drawing is oriented downward. When the motor circuit 150 illustrated in FIG. 10 is used, an electromagnet section for moving the impeller 20 may be provided separately from the electromagnet section 40 for transmitting rotational power from the motor 61 to the impeller 20.

A switch that interrupts an electrical current to the electromagnet section 40 after the elapse of a set period of time from the receipt of a control signal that turns off the pump 1 may be added to the motor circuit 150 illustrated in FIG. 10. By the addition of the switch interrupting the electrical current to the electromagnet section 40, the electrical current flowing in the electromagnet section 40 may be interrupted during stoppage of the pump 1. When the electrical current flowing in the electromagnet section 40 is interrupted after the impeller 20 is housed in the housing section 31, the impeller 20 remains in the housing section 31 by its own weight.

Because the impeller 20 is moved to the housing section 31 in the above-described configuration more quickly than that in the pump 1 illustrated in FIG. 1, the time for which the stopped impeller 20 is an obstacle to the channel may be reduced.

Figure 11:
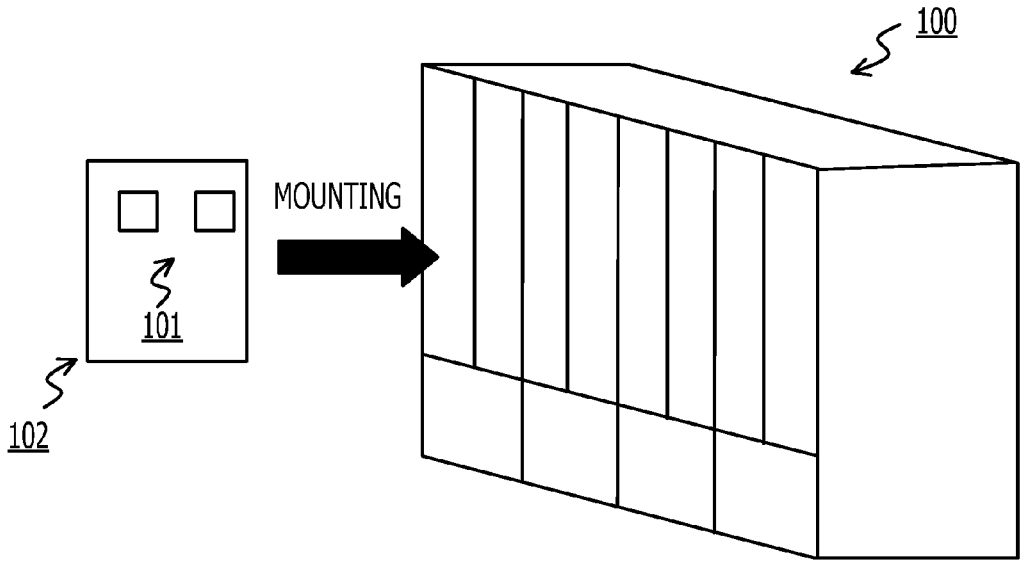
FIG. 11 illustrates an exemplary communication apparatus.

FIG. 11 illustrates an exemplary communication apparatus. A unit 102 including an electronic component 101 being one example of heat-generating equipment is mounted in a communication apparatus 100 illustrated in FIG. 11. The communication apparatus 100 transmits and receives various kinds of data and may have redundancy from the aspect as a social infrastructure. Thus, a cooling system that cools the electronic component 101 may have redundancy.

Figure 12:
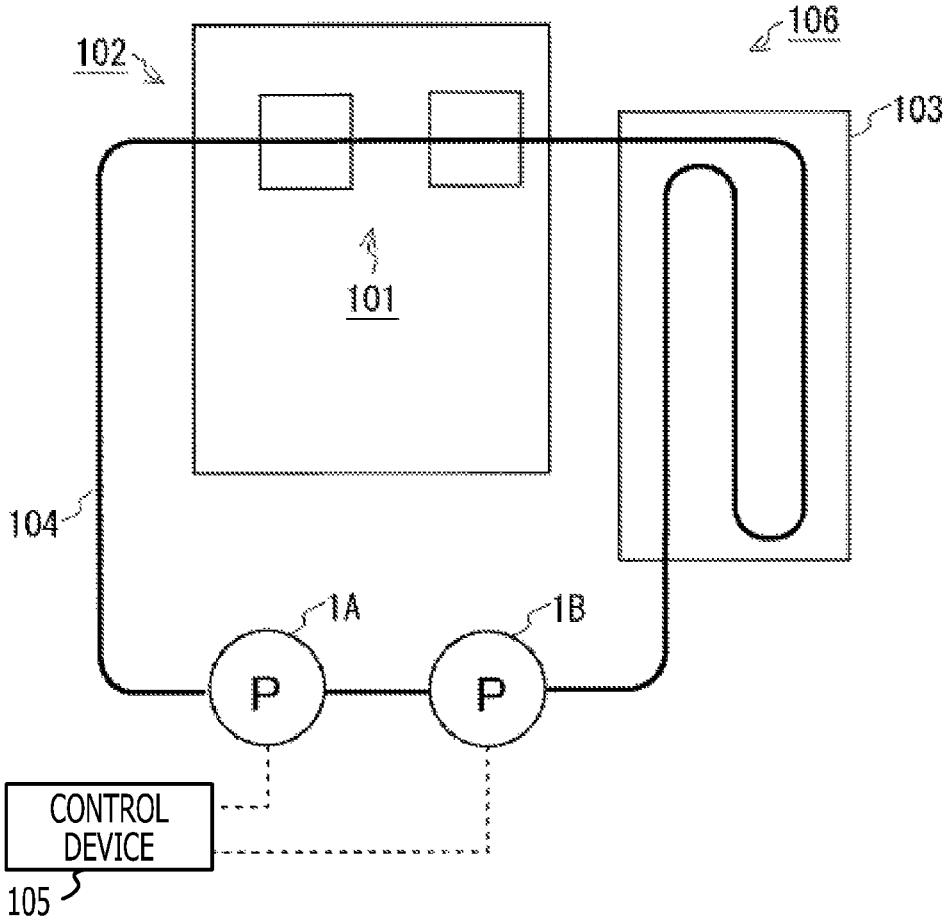
FIG. 12 illustrates an exemplary cooling system.

FIG. 12 illustrates an exemplary cooling system. For example, a cooling system 106 illustrated in FIG. 12 includes pumps 1A and 1B corresponding to the pump 1 illustrated in FIG. 1, a heat exchanger 103, a circulation channel 104, and a control device 105. The control device 105 sends a control signal to the motor circuit 50 included in each of the pumps 1A and 1B. The cooling system 106 removes heat from the electronic component 101 disposed along the circulation channel 104 by the use of a cooling medium, one kind of fluid, and dissipates the heat to the outside of the system. The pumps 1A and 1B may be disposed in series on the circulation channel 104. The cooling medium circulates through the circulation channel 104 when at least one of the pumps 1A and 1B is in a running state.

The cooling medium may be either liquid or gas that may be the fluid; liquid may efficiently cool the heat-generating equipment. Only one pump 1 illustrated in FIG. 1, or alternatively, a plurality of, for example, three or more pumps 1 may be disposed on the circulation channel 104 in the cooling system 106.

Figure 13:
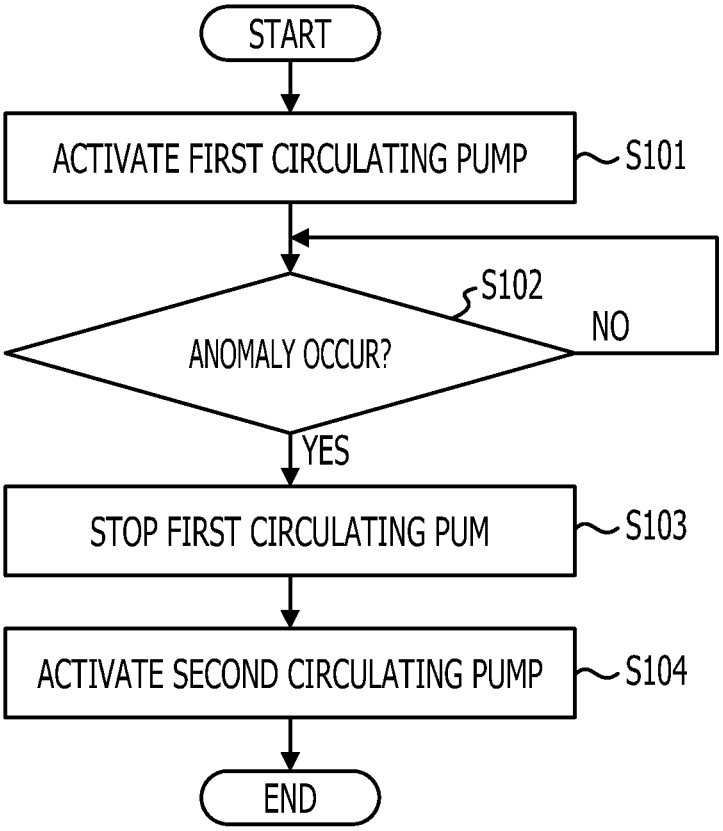
FIG. 13 illustrates an exemplary control process.

FIG. 13 illustrates an exemplary control process. The control device 105 illustrated in FIG. 12 may perform the control process illustrated in FIG. 13.

(In operation S101) When the communication apparatus 100 is activated, the control device 105 activates either one of the pumps 1A and 1B (hereinafter referred to as the first pump). The electromagnet section 40 in the activated first pump is brought to an energized state, and the impeller 20 moves from the housing section 31 to the pump chamber channel 33. The impeller 20 having moved to the pump chamber channel 33 is driven inside the pump chamber channel 33 by power transmitted from the electromagnet section 40 rotated by the motor 61 through magnetism.

(In operation S102) The control device 105 monitors the presence or absence of an anomaly of the first pump. The presence or absence of an anomaly of the pump may be determined based on various parameters representing the statuses of the pump. Examples of the parameters representing the statuses of the pump may include the amount of flow of the cooling medium flowing through the circulation channel 104, the electrical current of the motor 61, the number of revolutions of the motor 61 or impeller 20, and the electrical current value of the electromagnet section 40.

(In operation S103) When detecting an anomaly of the first pump, the control device 105 stops the first pump. The electromagnet section 40 in the stopped first pump is brought to a non-energized state, and the impeller 20 moves from the pump chamber channel 33 to the housing section 31. Thus, the channel coupling the inlet and outlet of the first pump and allowing the cooling medium to flow therethrough inside the pump casing 30 is ensured. For example, obstruction to circulation of the cooling medium by the impeller 20 of the first pump may be reduced. The impeller 20 having moved to the housing section 31 loses power transmitted from the electromagnet section 40 through magnetism and comes to a stop.

(In operation S104) After stopping first pump, the control device 105 activates the other pump having stopped so far out of the pumps 1A and 1B (hereinafter referred to as the second pump). The impeller 20 in the activated second pump moves to the inside of the pump chamber channel 33 and is driven inside the pump chamber channel 33. The stopping of the first pump ensures the channel coupling the inlet and outlet of the first pump and allowing the cooling medium to flow therethrough inside the pump casing 30. Thus, the activation of the second pump enables the cooling medium to normally circulate in the circulation channel 104.

When the control device 105 performs the control process illustrated in FIG. 13, one stopped pump out of the pumps 1A and 1B may be used as a reserve pump. Thus, when a plurality of pumps are disposed in series, a path for bypassing the pumps is not provided, and redundancy of the cooling system 106 may be achieved.

The impeller 20 included in each of the pumps 1A and 1B is driven by power transmitted through magnetism. For example, the pumps 1A and 1B may not include a power transmission shaft or a shaft seal for use in the pump. Thus, the pump casing 30 and the motor casing 60 in the pump 1 may be formed such that they may be separated. For example, if an anomaly based on the motor 61 in the first pump occurs in the first pump, the motor 61 in the first pump may be replaced or repaired without stopping of the second pump.

Figure 14:
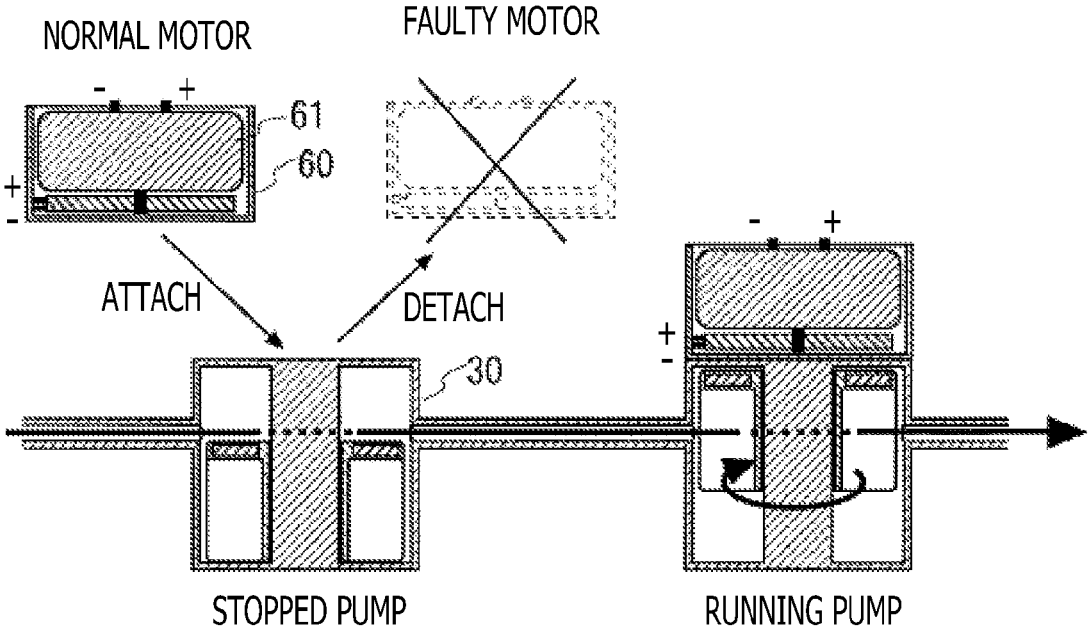
FIG. 14 illustrates an exemplary replacement of a motor.

FIG. 14 illustrates an exemplary replacement of a motor. In FIG. 14, the motor 61 in the first pump may be replaced. If the motor 61 in the first pump has broken down, this faulty motor 61 is detached together with the motor casing 60, and a normal motor 61 is attached. The pump casing 30 is sealed except for the connections with the pipes attached to the outer circumferential surface of the pump casing 30. Thus, if the motor 61 or the motor casing 60 is detached from the pump casing 30, leakage of the cooling medium flowing inside the pump casing 30 is reduced. The pump 1A is repaired in a state where the pump 1B runs.

Examples of the cause of a breakdown of the pump include a breakdown of an electric component, such as a motor, and abrasion of a bearing or a shaft seal section of the motor. The impeller 20 in the pump 1 illustrated in FIG. 1 is driven by power transmitted through magnetism from the electromagnet section 40, thus making the fluid flow. Because the pump 1 illustrated in FIG. 1 includes no shaft seal section, breakdowns may be reduced. In the case where a breakdown occurs in a component inside the pump casing 30, if the impeller 20 is housed in the housing section 31, another pump continues running while the faulty pump is set aside, the cooling system 106 may maintain its cooling function.

Figure 15:
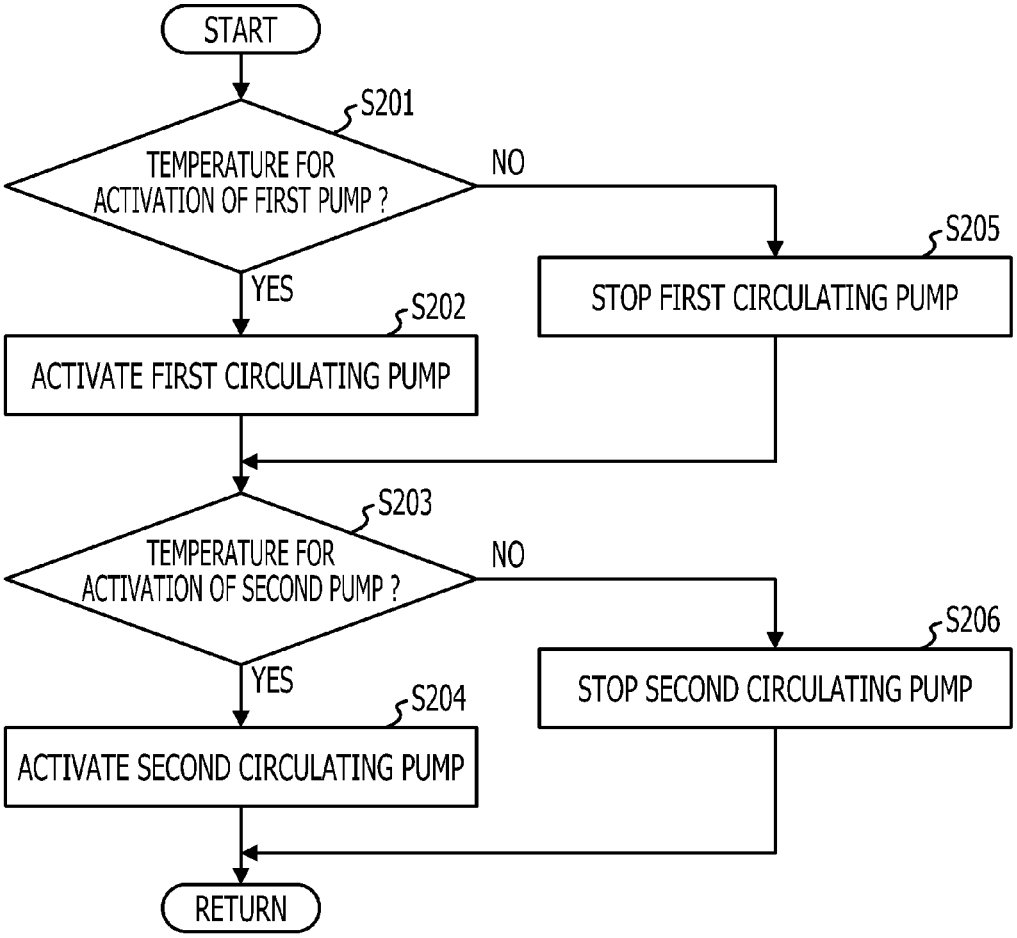
FIG. 15 illustrates an exemplary control process.

FIG. 15 illustrates an exemplary control process. The control device 105 illustrated in FIG. 12 may perform the control process illustrated in FIG. 15.

(In operation S201) When the communication apparatus 100 is activated, the control device 105 illustrated in FIG. 12 monitors the temperature of the electronic component 101.

The temperature of the electronic component 101 may be obtained from a signal of a temperature sensor (not illustrated) disposed in the vicinity of the electronic component 101 or from temperature data output from the electronic component 101. The pumps 1A and 1B in the cooling system illustrated in FIG. 12 may fail to become an obstacle to the circulation channel 104 in a state where the pumps 1A and 1B are stopped. Thus, when the circulation channel 104 expects a natural flow of the cooling medium, hindrance to the natural flow is reduced.

(In operation S202) When the temperature of the electronic component 101 reaches a value preset as the temperature at which the first pump is activated, the control device 105 activates the first pump.

(In operation S203) After activating the first pump, the control device 105 monitors the temperature of the electronic component 101.

(In operation S204) When the temperature of the electronic component 101 reaches a value preset as the temperature at which the second pump is activated, the control device 105 activates the second pump.

(In operation S205) When the temperature of the electronic component 101 is below the value preset as the temperature at which the first pump is activated, the control device 105 stops the first pump.

(In operation S206) When the temperature of the electronic component 101 is below the value preset as the temperature at which the second pump is activated, the control device 105 stops the second pump.

When detecting an anomaly of the pump in a repetition of operations S201 to S206, the control device 105 performs a subroutine.

Figure 16:
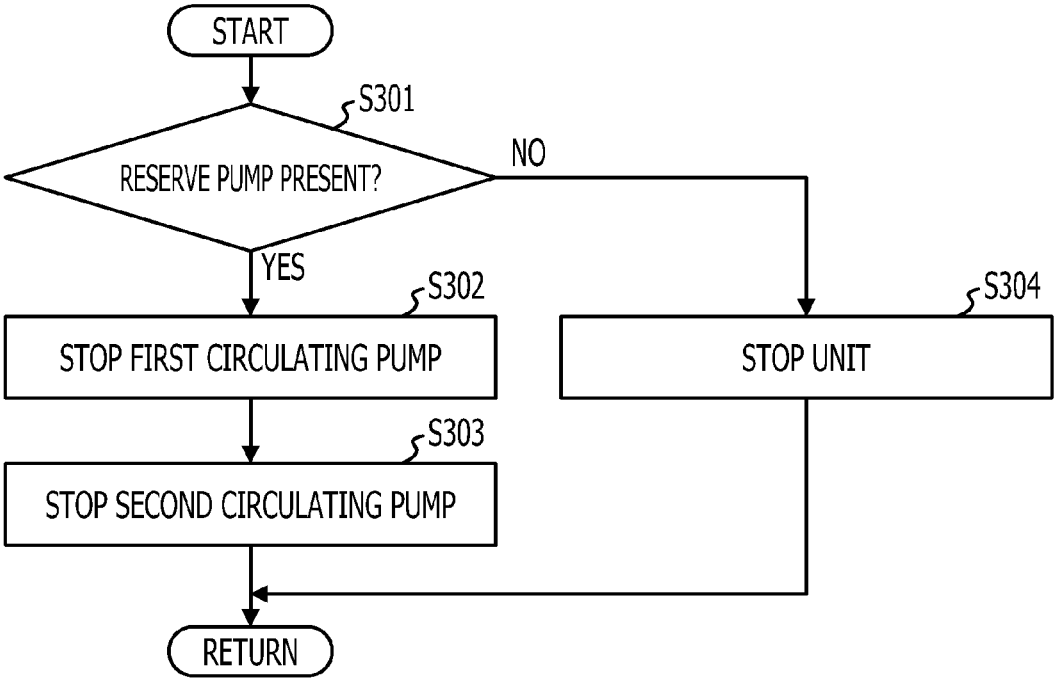
FIG. 16 illustrates an exemplary processing of a control device.

FIG. 16 illustrates an exemplary processing of the control device. The processing illustrated in FIG. 16 may be a subroutine performed by the control device illustrated in FIG. 12.

(In operation S301) When detecting an anomaly of the pump in a repetition of operations S201 to S206, the control device 105 determines the presence or absence of a reserve pump. For example, when both the pumps 1A and 1B are running or when a stopped pump out of the pumps 1A and 1B is faulty, the control device 105 determines that there is no reserve pump.

(In operation S302) When determining that there is a reserve pump in operation S301, the control device 105 stops the first pump.

(In operation S303) After stopping the first pump, for example, the pump in which an anomaly has been detected, the control device 105 activates the second pump, for example, the pump as the reserve pump.

(In operation S304) When determining that there is no reserve pump in operation S301, the control device 105 stops the unit 102 to be cooled by in the cooling system 106.

For example, power supplied to the unit 102 is interrupted to protect the electronic component 101 against a breakdown based on an increase in temperature.

When the control device 105 performs the control process illustrated in FIG. 15, an appropriate number of pumps may be run in accordance with the temperature of the electronic component 101, and one stopped pump out of the pumps 1A and 1B may be used as a reserve pump. Thus, power consumption of the pumps may be reduced, and redundancy of the cooling system 106 may be achieved.

Figure 17:
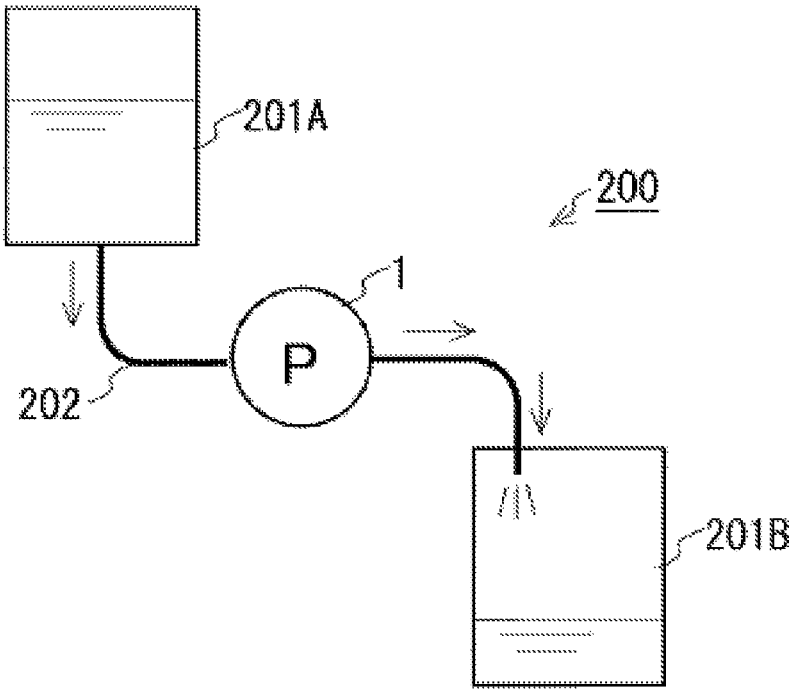
FIG. 17 illustrates an exemplary transport system.

FIG. 17 illustrates an exemplary transport system. A transport system 200 illustrated in FIG. 17 transports liquid inside a tank. The pump 1 illustrated in FIG. 1 may be used in a circulation channel through which fluid circulates. The pump 1 illustrated in FIG. 1 may be used in a channel through which fluid does not circulate.

For example, the pump 1 illustrated in FIG. 1 may be used in the transport system 200 in which tanks 201A and 201B are coupled to each other with a pipe 202, as illustrated in FIG. 17. When the pump 1 illustrated in FIG. 1 is disposed on the pipe 202 in the transport system 200, even if the pump 1 is broken down, liquid may be transported employing a height difference or a pressure difference between the tanks 201A and 201B.

Even if the pump 1 comes to a stop, the impeller 20 may fail to become an obstruction to the channel for fluid.

A plurality of pumps 1, at least one of which is illustrated in FIG. 1, may be disposed on the pipe 202 in the transport system 200. The control device for controlling each of the pumps 1 may perform the processes illustrated in FIGS. 13, 15, and 16.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. A pump comprising:

an impeller that moves fluid and includes a magnetic element;

a housing section, provided adjacent to a channel for the fluid, that communicates with the channel;

an electronic circuit configured to control a position of the impeller; and an electromagnet section provided in a location opposite to the housing section such that the channel is disposed between the electromagnet section and the housing section, wherein the electronic circuit positions the impeller in the channel using attraction of the magnetism of the electromagnet section during a driving of the impeller, and the electronic circuit houses the impeller in the housing section using repulsion of the magnetism of the electromagnet section during a stoppage of driving of the impeller.

2. The pump according to claim 1, wherein the magnetic element is controlled by the electromagnet section.

3. The pump according to claim 1, wherein the electronic circuit energizes the electromagnet section by supplying an electric power to the electromagnet section, and the electronic circuit stops energizing the electromagnet section by stopping the supply of the electric power to the electromagnet section.

4. The pump according to claim 1, wherein the impeller includes a permanent magnet as the magnetic element.

5. The pump according to claim 1, wherein the electronic circuit includes:

a power source; and a switch configured to supply an electric power to the electromagnet section from the power source in accordance with a control signal.

6. The pump according to claim 1, further comprising,
a motor that rotates the electromagnet section,
wherein the electronic circuit positions the impeller in the channel during a driving of the motor, and the electronic circuit houses the impeller in the housing section during a stoppage of driving of the motor.

* * * * *